US006601755B2

(12) United States Patent
Gillespie, IV

(10) Patent No.: US 6,601,755 B2
(45) Date of Patent: Aug. 5, 2003

(54) ENVELOPE WITH RESEALABLE FLAP

(76) Inventor: Henry Carter Gillespie, IV, 2824 Main, Ingleside, TX (US) 78362

( * ) Notice: Subject to any disclaimer, the term of this patent is extended or adjusted under 35 U.S.C. 154(b) by 0 days.

(21) Appl. No.: 09/929,792

(22) Filed: Aug. 14, 2001

(65) Prior Publication Data

US 2002/0023948 A1 Feb. 28, 2002

Related U.S. Application Data

(60) Provisional application No. 60/228,598, filed on Aug. 28, 2000.

(51) Int. Cl.[7] ..... B65D 27/00
(52) U.S. Cl. ..... 229/70; 229/74
(58) Field of Search ..... 229/68.2, 70, 74, 229/69; 383/11; 40/771, 773, 774, 775

(56) References Cited

U.S. PATENT DOCUMENTS 689,298 A * 12/1901 Fried ..... 229/69
705,006 A * 7/1902 Winton ..... 229/69
1,434,097 A * 10/1922 Conner ..... 229/68.1
1,494,827 A * 5/1924 Warner ..... 229/74
1,710,603 A * 4/1929 Benenato ..... 229/69
2,013,844 A * 9/1935 Sherman ..... 229/69
2,096,559 A * 10/1937 Riley ..... 40/771 X
2,142,843 A * 1/1939 Harris ..... 40/771
2,614,350 A * 10/1952 Kneifel et al. ..... 229/74 X
2,671,602 A * 3/1954 Vogt ..... 229/69 X
5,634,587 A * 6/1997 Popat et al. ..... 229/69

* cited by examiner

*Primary Examiner*—Jes F. Pascua
(74) *Attorney, Agent, or Firm*—G. Turner Moller

(57) ABSTRACT

A pouch envelope of otherwise conventional type includes a supplemental flap. In one embodiment, the supplemental flap is secured to the address side of the envelope by an adhesive. In another embodiment, the supplemental flap comprises an extension of the address side of the envelope. The supplemental flap is positioned adjacent the opening into the envelope and provides a resealable adhesive strip on the address side of envelope. The supplemental flap is preferably detachable, as by the provision of a perforate line along the edge of the envelope. The supplemental flap also provides a writing surface on the open side of the envelope so users can make notes on the supplemental flap, such as the date when the envelope was mailed, the person mailing the envelope, the person receiving the envelope, the date the envelope was delivered or the like. The detached supplemental flap thus provides a convenient note that may be used as file reminder or as a note to be placed on the door of the recipient.

11 Claims, 8 Drawing Sheets

Any standard or custom envelope

Standard or custom envelope
(or any type of stationary)

Fig. 4 Rear View

Front

Flap's dimensions will change with stationary style, i.e. standard envelope, custom sized stationary, or any type of material that might make up a vehicle for conveying or delivering images, or messages that can or will be designed.

Front edge view

ENVELOPE WITH RESEALABLE FLAP

This application is based on provisional application 60/228,598, filed Aug. 28, 2000.

BACKGROUND OF THE INVENTION

This invention relates to an envelope having a supplemental flap that can be written upon to provide pertinent messages.

This invention is a simple and efficient means of improving the way people look at and handle the everyday chores of messaging in the work place, at home, and in all industrial, commercial, and private sectors.

SUMMARY OF THE INVENTION

This invention is nothing more than an additional flap applied to either custom-designed or existing standard stationary envelopes to make them readily available for easy use. This invention not only permits multiple reuse of the envelope, but also provides a constant reminder of importance until it is submitted via either postal, courier, or any other means of delivery. What makes this invention unique is the manner in which it makes the user aware of its presence by hanging where it will be most noticed. This is achieved by having an adhesive that is re-sealable, or one that releases when needed, but not limited to the adhesive type or quality available already on the market. In this way, time and efficiency will greatly be enhanced, since time lost looking for items to send will now be in plain sight.

This invention comes in variations, including one with a perforated edge for ease of removal, thus creating an instant ticker or receipt, and another with an add-on flap which can be attached to any plastic, paper, or synthetic material. The manner in which this invention is employed will vary depending on the environmental setting. In the office, this invention will initially be used in the "add-on" mode using a suitable dispenser to retro-fit supplies, until office stationary is exhausted, after which custom-designed envelopes and other containers can be supplied. This applies to the other environmental settings as well. In the add-on mode, may be made in numerous style adaptations, including but not limited to color, size, and material.

In the commercial market, this invention allows many, if not all of the common carriers, to replace the existing messaging instruments. It will make dropping off customer letters much more convenient for the courier by giving them the means to affix the letter, or small parcel to the customers door, instead of leaving it shoved in the door knob, or simply left on the floor.

This invention may be constructed of various materials, including paper, metal, all natural, and synthetic substances. The size will vary to accommodate the various designs of stationary already existing on the market. The exact dimensions of the invention may change due to the differences in existing stationary. It is because of this that dimensions have intentionally been omitted, but this does not in anyway limit the overall design, or concept of the invention. The add-on flap's dimensions will change due to the ever-changing supply of custom and standard stationary. However, the flap will have sufficient flap space to allow the user to make notes, or enter in any medium they feel fit, and will be durable enough to allow such entry. The lower portion will have an adhesive that sufficiently adheres to the product, but will as an option release and readhere; some will be more permanent than others. The invention, once attached, provides a surface to attach the two to a variety of areas, and provide a message reminder of the event. On the reverse side, the resealable flap of this invention has adhesive at the upper edge in sufficient quantity to allow for temporary or permanent attachment. To efficiently dispense the invention, a suitable dispenser may be provided. In the manufacture of custom made envelopes, a resealable flap of this invention may be incorporated into the standard stationary design by simply adding an additional flap to the backside of the envelope. This may be accomplished by using adhesives and folds pressed during manufacturing that will combine the flap of this invention into a traditional style stationary. The type of adhesive, manufacturing specifications, and are not limited in kind since variations in standard and custom stationary are ever changing. The sole essence of the invention contends that the basic elements remain, which are a flap, that can attach, or can be attached, to stationary, and has an adhesive that can then attach the stationary to many different things where it can be viewed in conspicuous places.

DETAILED DESCRIPTION

Figure 1:
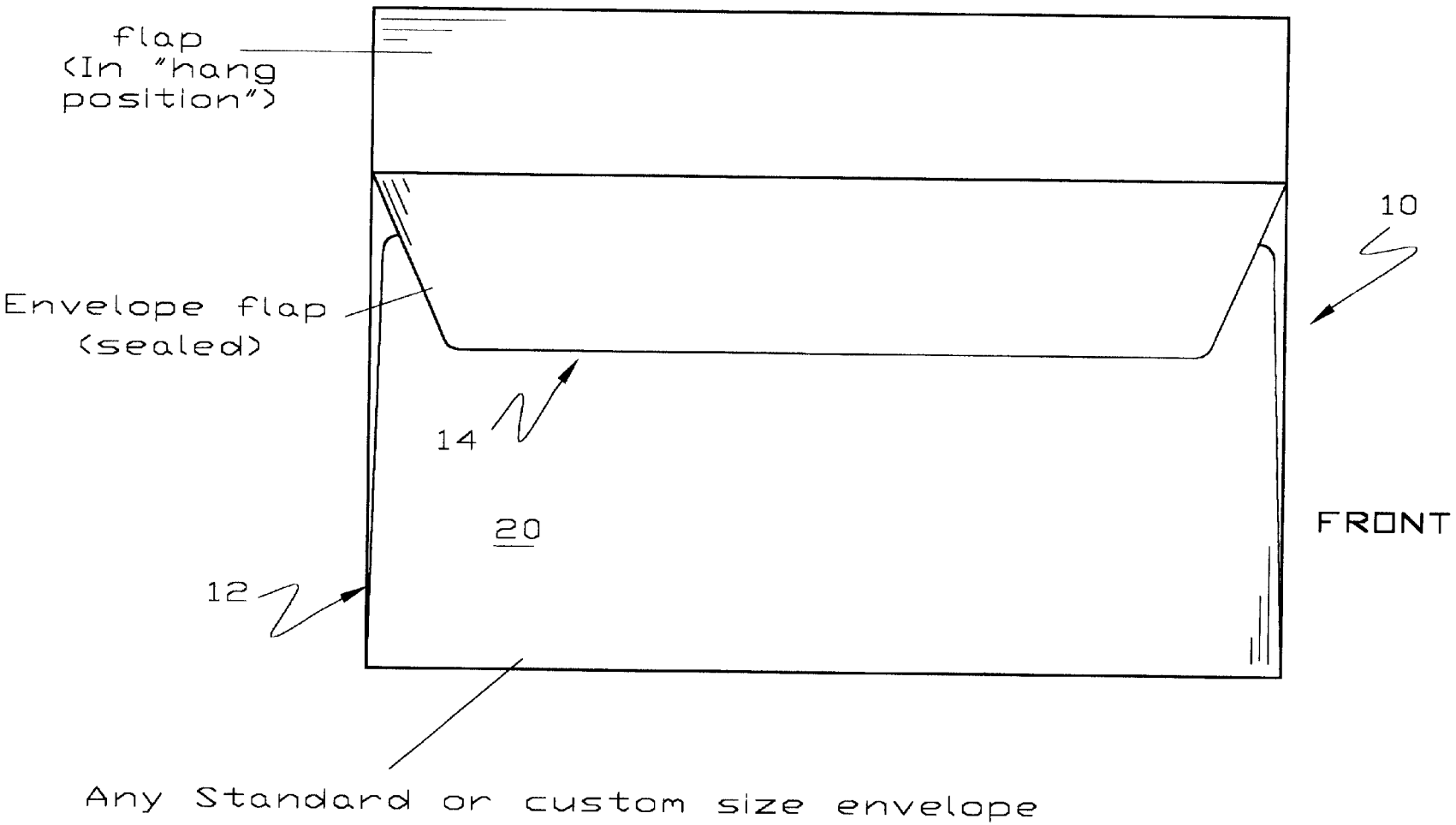
FIG. 1 is a view of the front side of an envelope, showing the flap of this invention extending vertically from the top.
Figure 2:
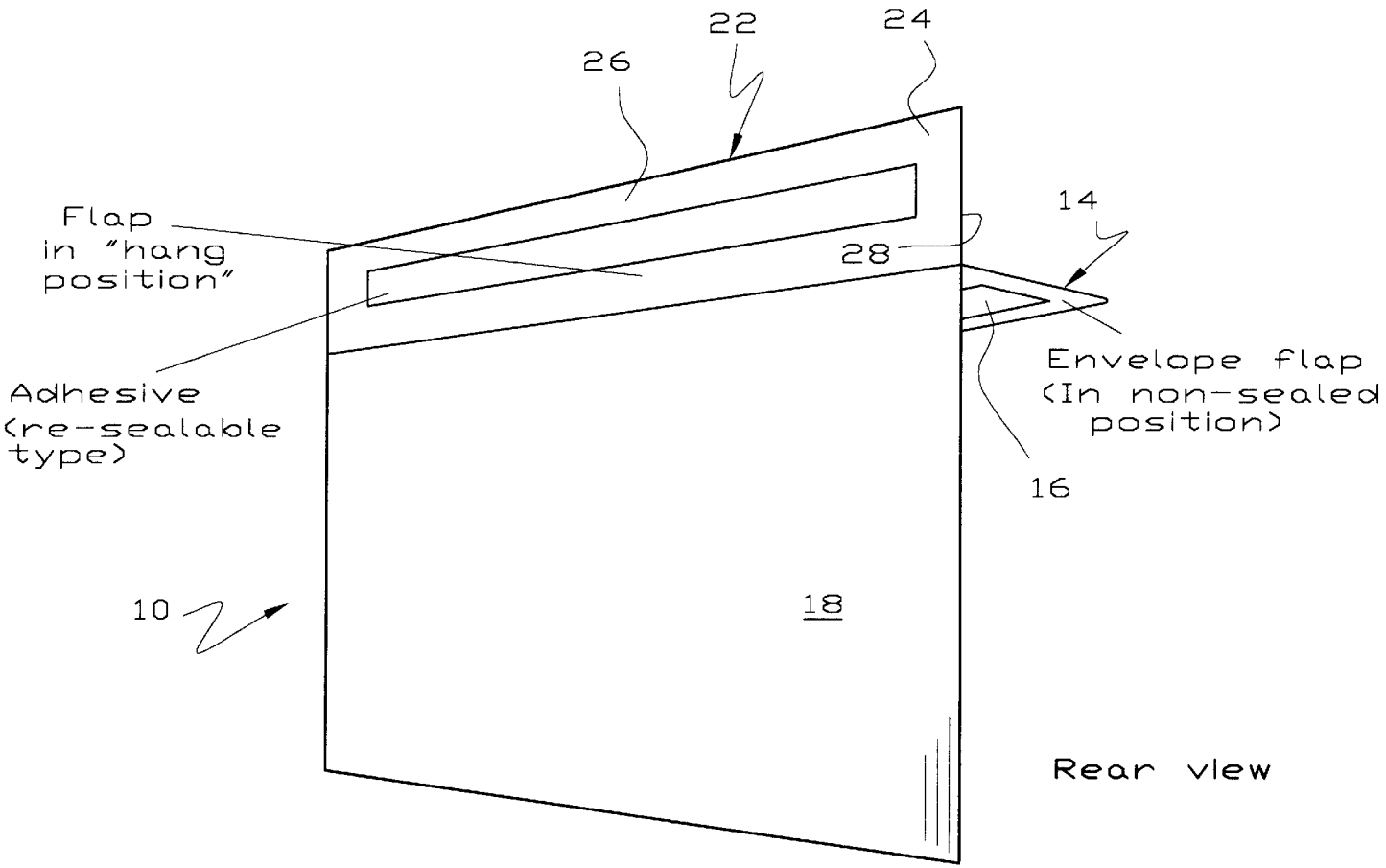
FIG. 2 is an isometric view of the address side of the envelope of FIG. 1 showing the flap of this invention extending vertically from the top.
Figure 3:
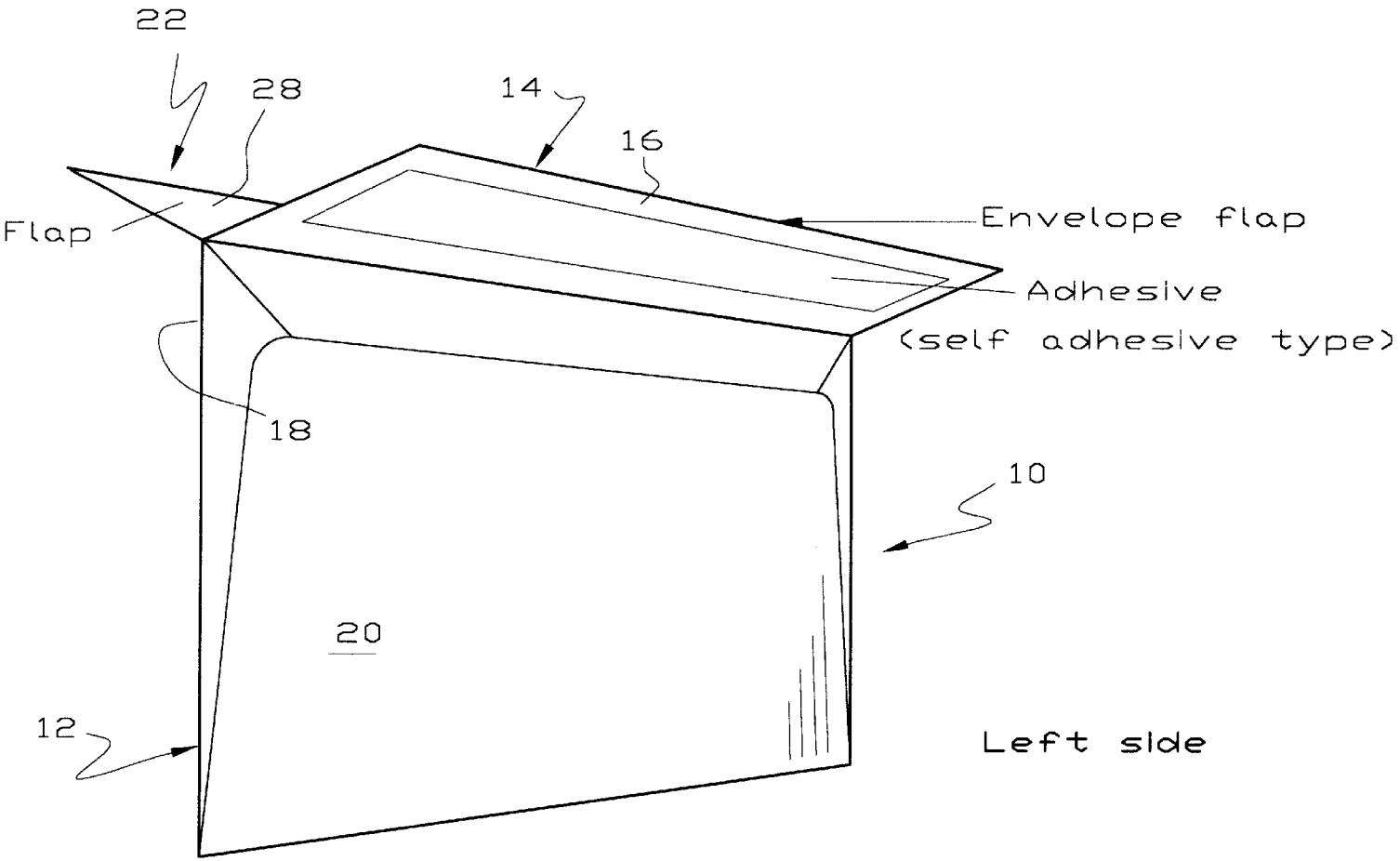
FIG. 3 is an isometric view of the front side of the envelope of FIGS. 1–2.

Referring to FIGS. 1–3, there is illustrated a suitably sized envelope 10 made of a suitable material and providing a pouch 12 and a flap 14 having an adhesive strip 16 for sealing the envelope 10. The pouch 12 includes an address side or panel 18 and an access side or panel 20 which terminates below the top of the pouch 12 thereby providing access to the interior of the pouch 12. A flap 22 of this invention is incorporated into the envelope 10 and provides a face 24 on the address side of the envelope 10 having an adhesive strip 26 thereon and a face 28 providing a writing surface. The flap 22 may accordingly be hung from a suitable support by pressing the adhesive strip against a support. Writing may be done on the face 28.

Figure 4:
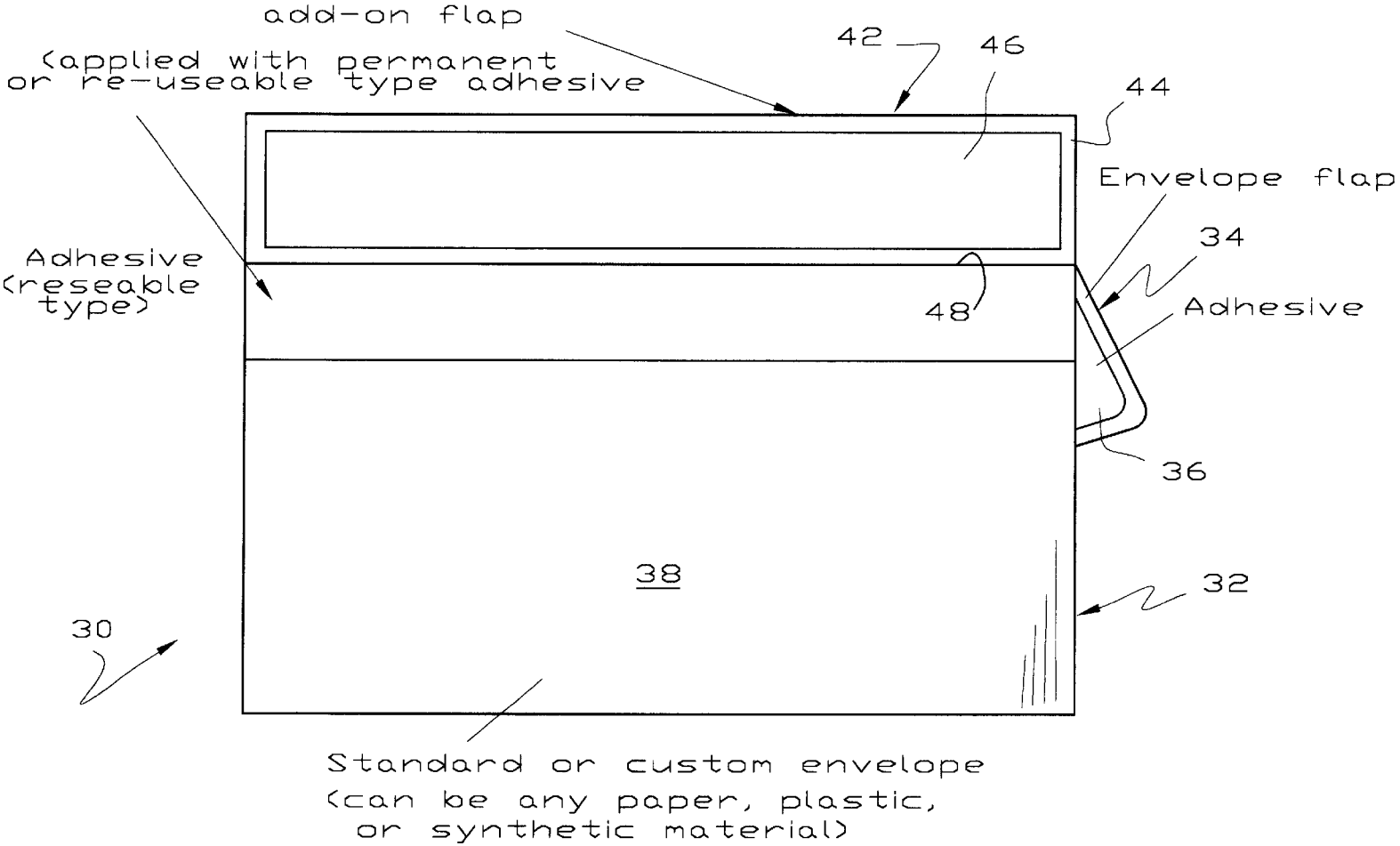
FIG. 4 is a view of the back or address side of an envelope with an add-on supplemental flap secured thereto.
Figure 5:
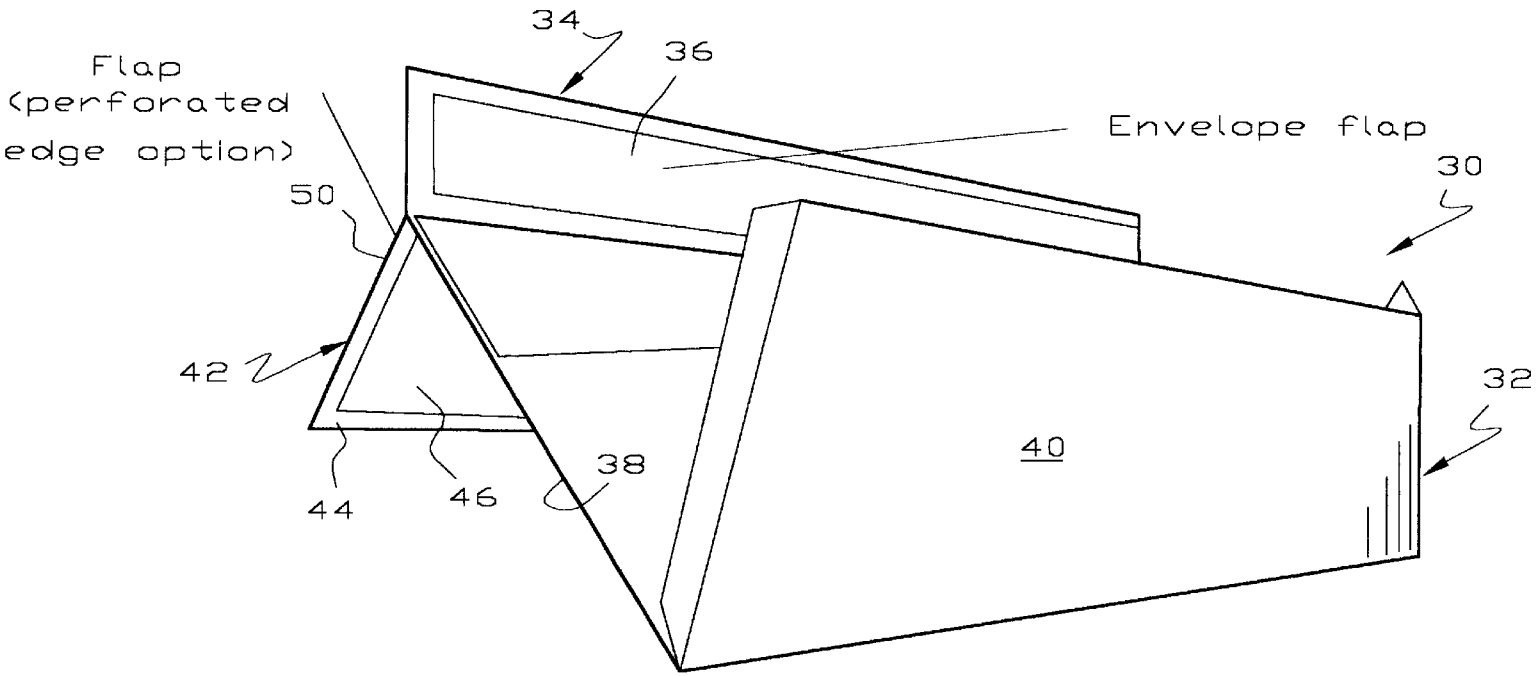
FIG. 5 is a partially unfolded view of the envelope of FIG. 4.
Figure 8:
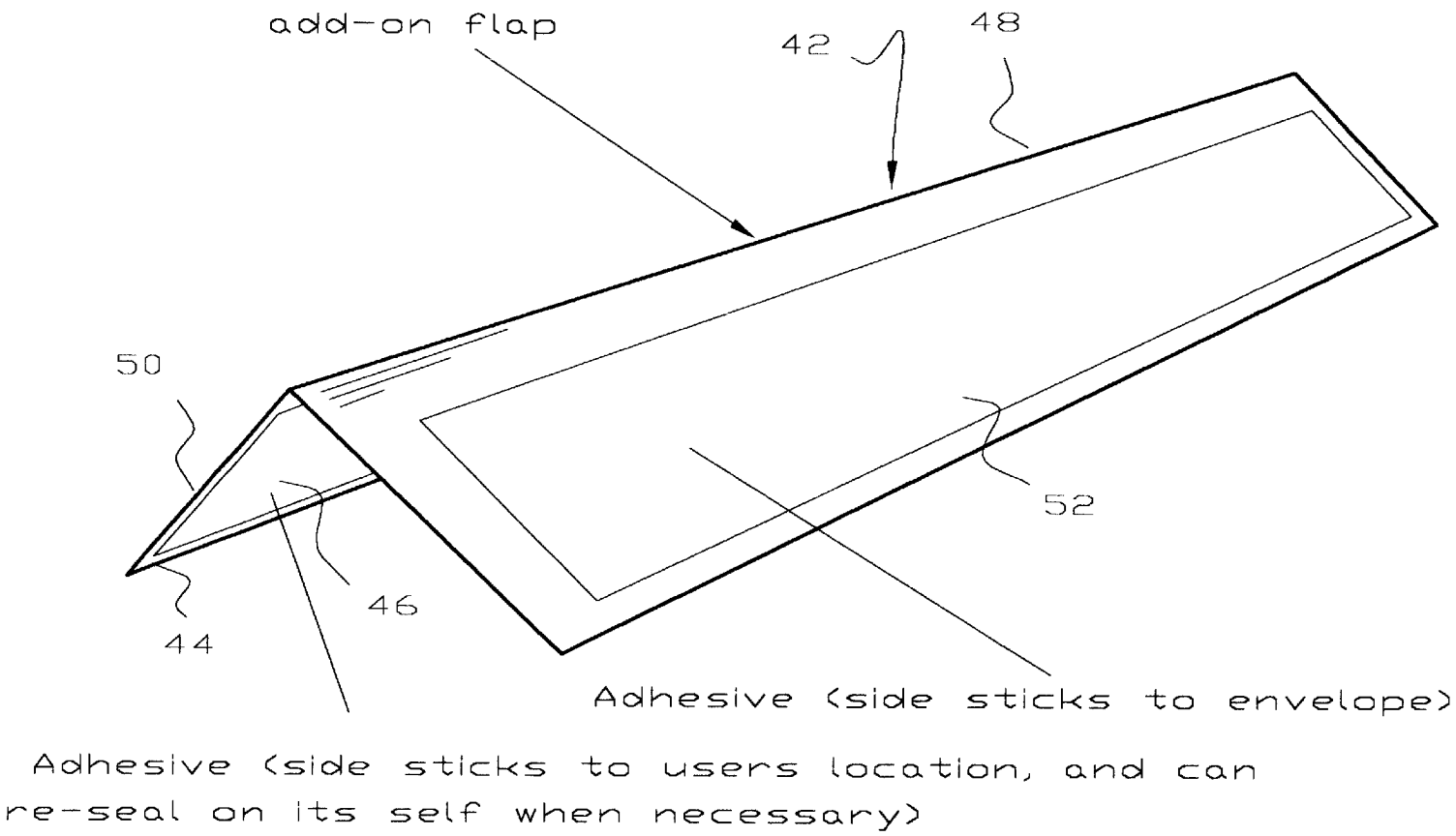
FIG. 8 is an isometric view of a bent add-on flap of this invention.

Referring to FIGS. 4, 5 and 8, there is illustrated an envelope 30 made of a suitable material and providing a pouch 32 and a flap 34 having an adhesive strip 36 for sealing the envelope 30. The pouch 32 includes an address side or panel 38 and an access side or panel 40 which terminates below the top of the pouch 32 thereby providing access to the interior of the pouch 32.

An add-on flap 42 of this invention is adhesively attached to the envelope 30 and provides a face 44 on the address side of the envelope 30 having an adhesive strip 46 above a line 48 and a face 50 providing a writing surface. Below the line 48 on the opposite side of the flap 42 is another adhesive strip 52. The strip 50 secures the flap 42 to the address side 38 of the envelope 30 as shown in FIG. 4. It will be seen that the envelope 30 may be suspended from a suitable support so writing on the face 50 is visible. In the add-on mode of FIGS. 4, 5 and 8, the flap 42 extends past the envelope's flap far enough to allow the adhesive on the flap 42 to attach to the backside of the envelope. In the add-on version of flap 42, the upper portion of the flap 42 provides an adhesive, preferably including but not limited to, adhesives with releasable qualities.

It will be apparent that the supplemental flaps of this invention may be made of a suitable material such as paper, plastic, natural, or synthetic, both as an incorporated version, and as the add-on version of FIGS. 4, 5 and 8.

Figure 6:
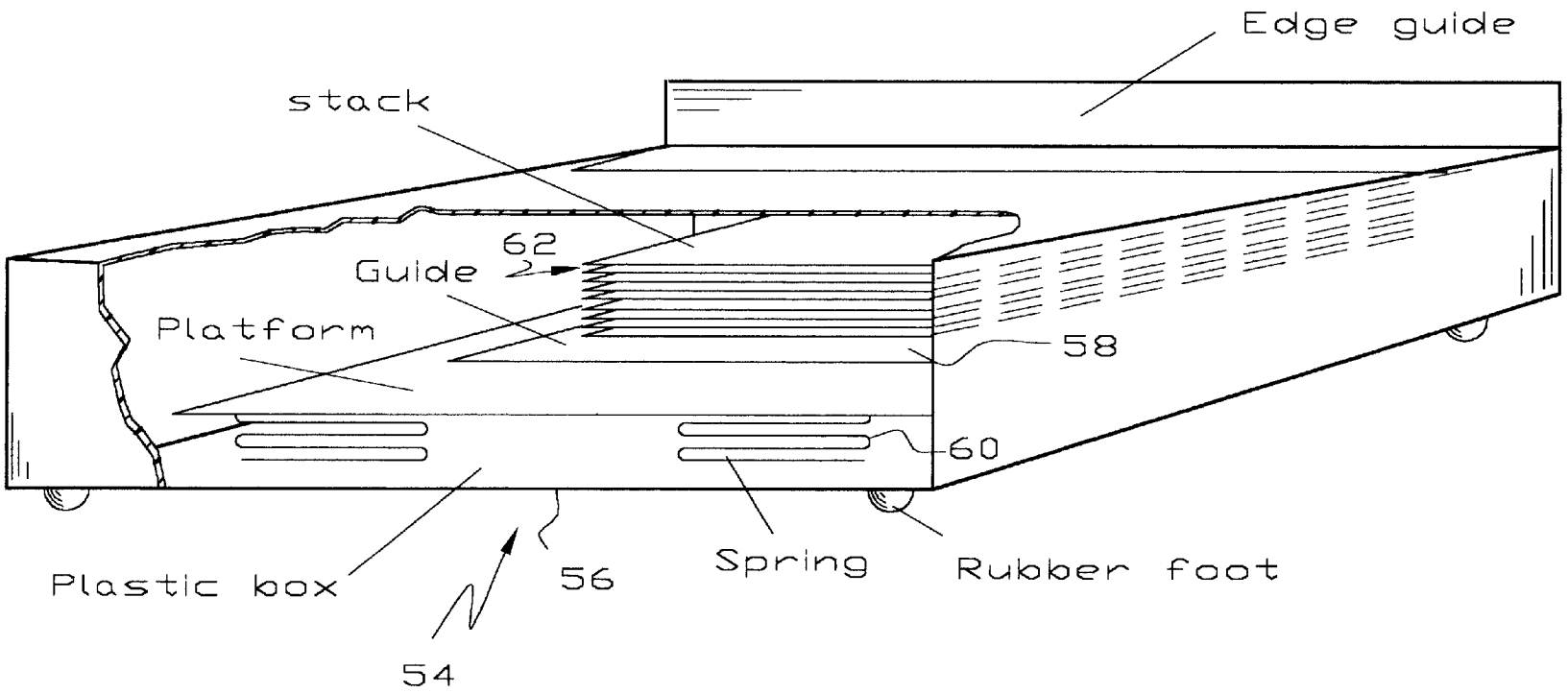
FIG. 6 is an isometric view looking toward the front edge of a dispenser of add-on flaps of this invention.
Figure 7:
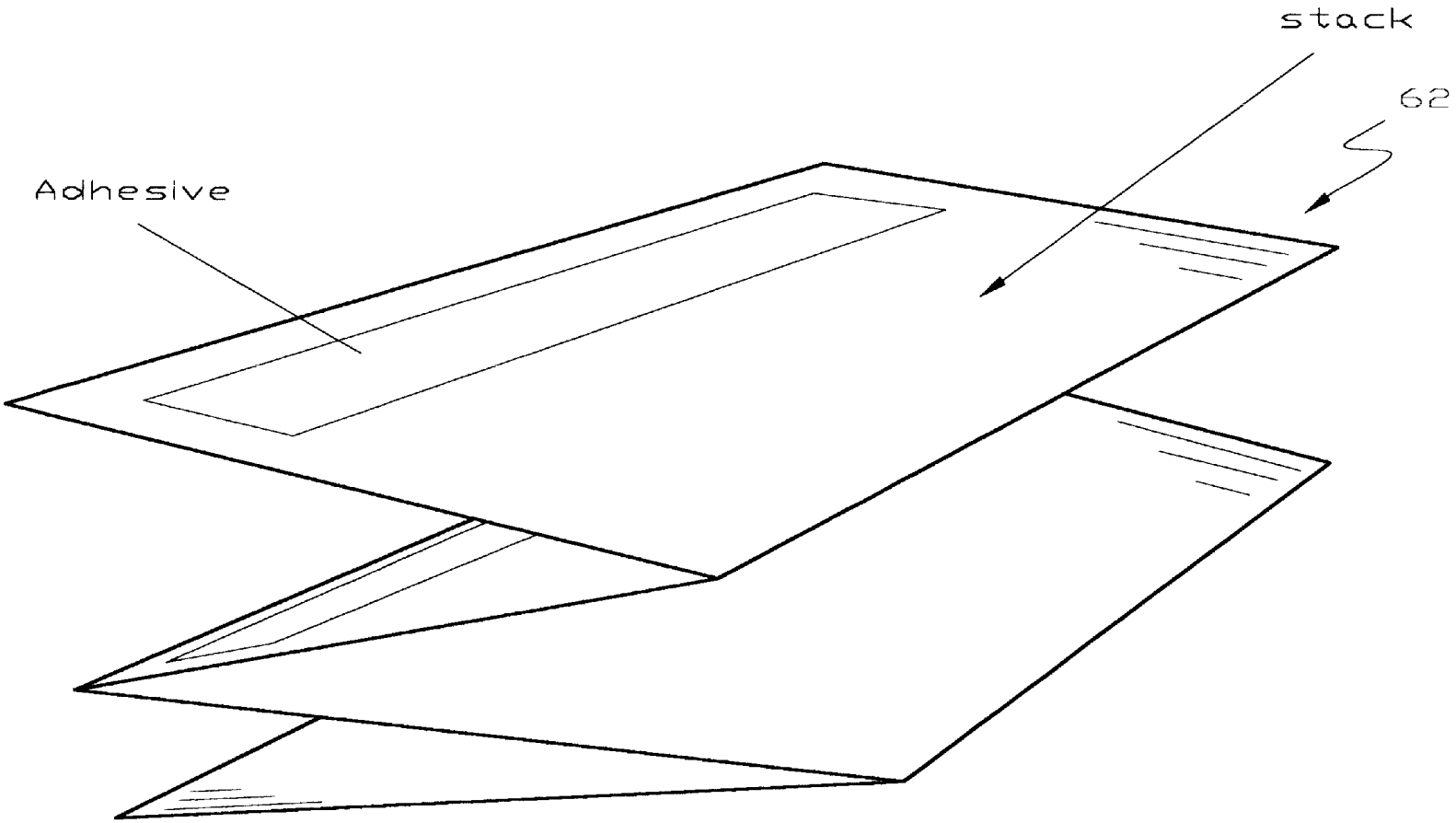
FIG. 7 is an exploded isometric view of a stack of add-on flaps of this invention.

Referring to FIGS. 6 and 7, a dispenser 54 includes a box 56 having a platform 58. A spring 60 biases a stack of flaps 62 50 they may be withdrawn by a user.

I claim:

1. An envelope having a flat pouch having an access side and an opposite side, a first flap movable from a first position allowing access to the pouch through the access side and a second position closing the access side, a first adhesive strip operable between the first flap and the pouch in the second position for securing a free end of the first flap to the pouch and thereby closing the access side, and a second flap secured to the pouch adjacent a side thereof and having a free end extending beyond the pouch and movable from a first position generally coplanar with the pouch and a second position overlying the opposite side of the pouch, the second flap having first and second opposing faces providing a second adhesive strip on the first face, the second face providing a writing surface and a third adhesive strip, the first face of the second flap facing the opposite side of the pouch in the second position of the second flap.

2. The envelope of claim 1 wherein the pouch comprises a multiplicity of edges and the edges join sides of the pouch at intersections and the pouch opens through an intersection and the access side.

3. The envelope of claim 2 wherein the first and second adhesive strips are continuous strips of adhesive.

4. The envelope of claim 2 wherein the second adhesive strip comprises a resealable adhesive.

5. The envelope of claim 2 wherein the first adhesive strip comprises a permanent adhesive.

6. The envelope of claim 1 wherein the pouch comprises a linear edge adjacent the access side and wherein the second flap is positioned adjacent the access side of the pouch for movement about an axis parallel to an edge of the pouch for movement to a third position juxtaposing the second adhesive strip to the opposite side of the pouch.

7. The envelope of claim 6 wherein the second face of the second flap is positioned above the access side of the pouch when the first face of the second flap is coplanar with the pouch.

8. The envelope of claim 7 wherein first and second flaps have length dimensions parallel to an edge of the pouch and the length dimensions are essentially the same.

9. The envelope of claim 8 wherein the second adhesive strip comprises a resealable adhesive.

10. The envelope of claim 9 wherein the pouch comprises a multiplicity of edges and the edges join sides of the pouch at intersections and the pouch opens through an intersection and the open side.

11. The envelope of claim 10 wherein the second flap comprises a perforate line parallel to the pouch edge adjacent the intersection between the edge and the open side.

* * * * *